US005569139A

United States Patent [19]

Civie et al.

[11] Patent Number: 5,569,139

[45] Date of Patent: Oct. 29, 1996

[54] COUNTER COMPRESSIVE FORCE EXERCISE MACHINE

[76] Inventors: Richard Civie, 320 Lambert Rd., Orange, Conn. 06477; Victor Civie, 248 Walnut St., Willimantic, Conn. 06226

[21] Appl. No.: 371,114

[22] Filed: Jan. 11, 1995

[51] Int. Cl.[6] ..... A63B 21/00; A63B 23/02

[52] U.S. Cl. ..... 482/137; 482/134; 482/139; 482/113; 482/100

[58] Field of Search ..... 602/32–35, 38–40; 482/100, 112, 135–139, 142, 148, 907, 113, 134

[56] References Cited

U.S. PATENT DOCUMENTS

| | | | |
|---|---|---|---|
| 963,890 | 7/1910 | Haas | 602/32 |
| 2,212,119 | 8/1940 | Julsrud et al. | 482/148 |
| 4,462,252 | 7/1984 | Smidt et al. | 482/134 |
| 4,494,750 | 1/1985 | Smith | 482/142 |
| 4,629,185 | 12/1986 | Amann | 482/113 |
| 4,867,142 | 9/1989 | Jones | 602/38 |
| 5,070,863 | 12/1991 | McArthur . | |
| 5,100,131 | 3/1992 | Fong . | |
| 5,108,090 | 4/1992 | Reed . | |
| 5,110,121 | 5/1992 | Foster . | |
| 5,129,881 | 7/1992 | Pope | 602/32 |
| 5,142,944 | 9/1992 | McArthur . | |
| 5,256,126 | 2/1992 | Grotstein . | |
| 5,362,298 | 11/1994 | Brown et al. | 482/113 |
| 5,409,452 | 4/1995 | Aversano | 482/142 |

FOREIGN PATENT DOCUMENTS

| | | | |
|---|---|---|---|
| 0222515 | 5/1910 | Germany | 482/142 |
| 2227677 | 8/1990 | United Kingdom | 602/32 |
| 89/04695 | 6/1989 | WIPO | 482/113 |

*Primary Examiner*—Richard J. Apley
*Assistant Examiner*—Victor K. Hwang

[57] ABSTRACT

An exercise machine utilizing a Exercise Resistive Device in conjunction with a Counter Compressive Force Device. The Exercise Resistive Device applies a resistive force to the users body in such a manner that it requires that the users muscles contract in order to execute an exercise. The Counter Compressive Force Device produces a counter force that opposes compressive forces acting on the body resulting from said exercise. Frictional and other destructive internal forces upon the body are consequently reduced or eliminated.

1 Claim, 6 Drawing Sheets

COUNTER COMPRESSIVE FORCE EXERCISE MACHINE

BACKGROUND OF THE INVENTION

This invention relates to an exercise machine employing principles designed to strengthen muscles without producing destructive forces on the bones, ligaments, and other body parts during exercise.

Typically, exercise machines designed to provide a subject the means to strengthen muscles employ some form of resistance the subject must overcome in order to complete the movement of the exercise. The forces used to generate this resistance also produce forces which tend to compress the joints and ligaments. This compression could result in injury to a subject. For example the forces used to generate this resistance as they apply to the back, can also produce a force downward on the spine which tends to compress the spine and disks subjecting this area to possible injury.

In many parts of the body as the muscles increase in strength, so to do the corresponding ligaments and bones. However, some bones and muscles can become injured if forces encountered during exercise are not correctly directed.

A number of machines have been devised to increase the strength of lower back muscles. U.S. Pat. Nos. 5,256,126, 5,142,944, 5,110,121, 5,100,131 and 5,070,863 describe machines that requires a subject to overcome a force with both parallel and perpendicular components on the back in a seated position. The subject is required to move part of the machine a certain distance.

U.S. Pat. No. 5,256,126 employs a barrier and seat. The subject is bent over seated in a chair at some fixed angle. Said subject exerts force on a barrier by pushing the barrier away when seated. The barrier is positioned in back of the subject. No attempt is made to restrict the compressive forces on the back. Said subject is required to exert a force directed upward and outward. The reactionary force has components directed downward thus subjecting the spine to possible injury by compressing the spine.

In U.S. Pat. No. 5,142,944 the subject is seated and has to overcome a force with both parallel and perpendicular components on the back. The parallel forces are directed in such a manner that would predispose a subject to injury by the compression of said subjects spine and back.

U.S. Pat. No. 5,110,121 consists of an exercise machine which requires the subject to be positioned in a chair. Contacts from said machine produce a force on the subject which tends to compress said subjects back.

U.S. Pat. No. 5,100,131 requires a subject to be positioned on a seat in such a manner that the restraints of the apparatus provide a resistive force on said subject. No attempt is made to reduce the compressive forces. Such forces as described will tend to compress said subjects back.

U.S. Pat. No. 5,070,863 describes a back exercise apparatus consisting of a chair and restraint. Here again, no attempt is made to reduce the compressive forces.

U.S. Pat. No. 5,108,090 describes a back exercising apparatus designed "To expand and contract to stretch the user's paraspinal and leg muscle." This apparatus does not require the user to perform a motion which will strengthen these muscles. No exercise resistance methods are employed.

SUMMARY OF THE INVENTION

The Counter Compressive Force Device Exercise Machine provides the means to strengthen muscles and associated body parts and reduce the risk of injury during exercise. Furthermore, it can promote recuperation from injury and minimize pain associated with an injury. By eliminating destructive forces while allowing those of a constructive nature, the body is given a chance to heal and growth is promoted. The successful use of this machine would result in a reduction of surgery and implants.

In review, the Counter Compressive Force device exercise machine:

applies counter compressive forces to the body to minimize or eliminate frictional and other undesirable forces in the body.

as it applies to the back the movement of the spine is restricted in such a way to prevent compression and eliminate undesirable forces in the body.

causes the subject to maintain correct positioning throughout the exercise thus insuring that body parts are not deformed in such a way to cause injury.

significantly decreases the chance of non exercised muscle injuries by requiring only the target muscles to contract.

eliminates those forces that cause the ligaments, bones and tendons to become injured.

promotes healing and growth in the body by permitting healthy pressure to act on the ligaments, tendons, and bones.

does not allow incorrect motions that would cause body parts to grind together, causing wear or disintegration, or that would subject said body parts to other injury.

promotes improved lifting techniques by minimizing the level of undesirable forces.

Although the machine as presented herein is depicted by numerous descriptions, it should not be construed as limiting the scope of the invention but moreover suggesting some preferred embodiments of this invention. For example, the Counter Compressive Force Device and the Exercise Resistance Device can employ springs, weights, elastics, pulleys, electromechanical, hydraulic, pneumatic and other force producing devices. Accordingly these devices can produce a force by either pulling or pushing areas of the body. Forces generated by the Counter Compressive Force Device can be accomplished by employing pulleys, levers, cams etc. in order to achieve the angles that provide the maximum desired effect. Passive devices with gears or cams can also be implemented to control the motion of the body interfaces and hence vary the amount of counter compressive force. The body restrainer can take the form of any one or more configurations such as seat belts and other rigid or semi-rigid barriers. Also this invention can be applied to safely benefit a wide range of muscle groups, not being limited to the ones described herein. This machine can be easily used by subjects suffering or recovering from diseases of the joints such as arthritis etc., by eliminating unwanted forces and friction on the joints. The function of the pivot links can be replicated by sliding or other types of mechanisms.

The breadth of the invention should be determined by the affixed claims and their legal equivalents, rather than by the examples presented herein.

DETAILED DESCRIPTION OF DRAWINGS

Figure 1:
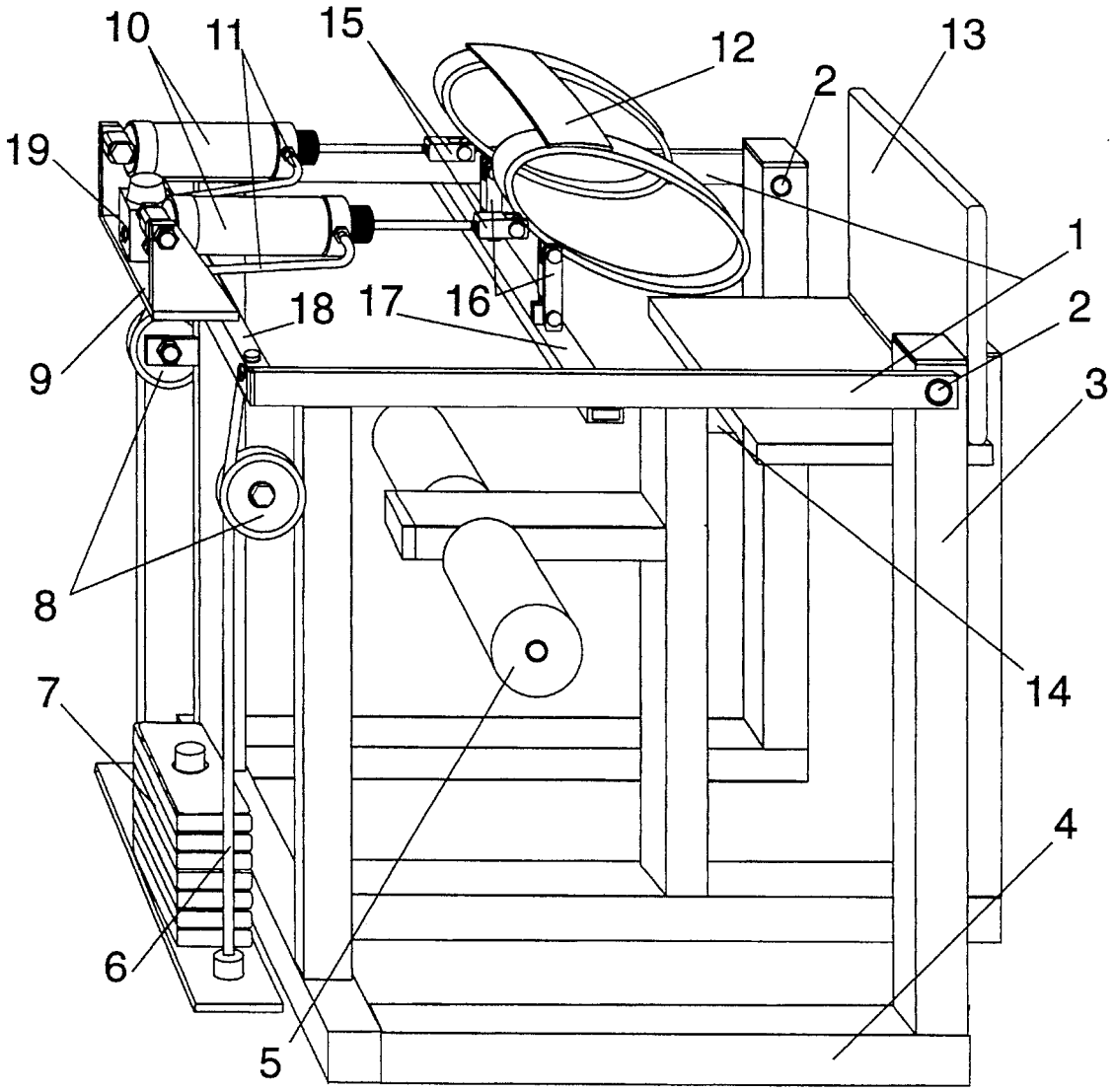
FIG. 1 is a perspective view of a representational embodiment of the invention.

FIG. 1—Perspective view of a representational embodiment of the invention.

Pivot arms 1 are mounted on the frame posts 3 by means of pivots 2. The pivot arm cross member 18 and force bar 17 are fixed into position as shown. Fixed to the top of the pivot arm cross member 18 is the pivot bracket 9 which holds the two, two inch bore three inch stroke single acting pull type pivot mount, air cylinders 10 in position. They are mounted to the pivot bracket 9 by inserting the proper sized shoulder bolt through the pivot holes found in each cylinder and then securing them with a nut, as illustrated in FIG. 1. At the opposite end, each air cylinder is fastened to the body interface 12 by means of a rod clevis 15.

Together these air cylinders act as the Counter Compressive Force Device. Air cylinder pressure is supplied and controlled by a conventional pressure regulator 19 which feeds the cylinders by means of the supply tubes 11. Pressure regulator 19 is supplied with compressed air by means of a standard air compressor and storage tank that is located apart from the machine proper (not shown).

The body interface is also attached to the pivot arms 1 via pivot links 16 and force bar 17. Force cables 6 are threaded through holes in the pivot arm cross member 18 with each cable fastened by means of a set screw. They are then threaded through the pulleys 8 and connected to the force device 7. Utilizing the force created by the weight of its steel plates, the force device acts against the rotational movement of the pivot arms when a force is applied to them through the body interface. The elements just described above in this paragraph, from the pivot arms to the force device, together act as the Exercise Resistive Device.

Many different types of materials can be used in the construction of this unit. The following represents materials and techniques of one embodiment.

Construction of the pivot arms 1 consist of rectangular steel tubing with 0.5" i.d. bronze bushings press fit into the sides 2. These bushings form the female part of the pivot 2. Holes in the frame posts 3 where the pivot arms attach accept the proper sized steel bearing rod held in place by retaining rings. The frame consists of a "E" shaped base 4 and six upright posts made of steel square tubing. These components are fixed together in the positions shown along with the seat support 14, which is a horizontal piece located under said seat 13. Two identical ball bearing cable pulleys 8 are used, mounted on 0.625" steel hex bolts. All cables are 0.25" twisted steel. In this example the body restrainers take the form of knee rest 5. They are high density urethane foam cylinders attached to a round steel tube. The tube is fixed to a horizontal frame attachment which in turn is fixed to the middle frame upright post. This along with the seat could be made adjustable to accommodate different people. Body interface 12 consists of two padded leather arm loops connected by a padded leather back support used as a human to machine interface. Rigid, semi-rigid or flexible materials can be substituted in many configurations in order to fulfill the requirements for comfort, strength and support. The seat 13 is made up of two pieces of 0.5" plywood. One piece affixed to the seat support 14 which forms the bottom part of the seat and the other is positioned vertically and attached to an upright forming the back. Foam padding or cushions can be added. The pivot links 16 are made from solid steel with milled slots. One end of each pivot link is connected to the body interface's integrated steel mount with a clevis pin. Connected to the other end, in the same manner, the pivot links are fastened to the force bar 17. Both the force bar 17 and cross member 18 are made from rectangular steel tubing. The pivot bracket 9 is made from steel plate.

Figure 2:
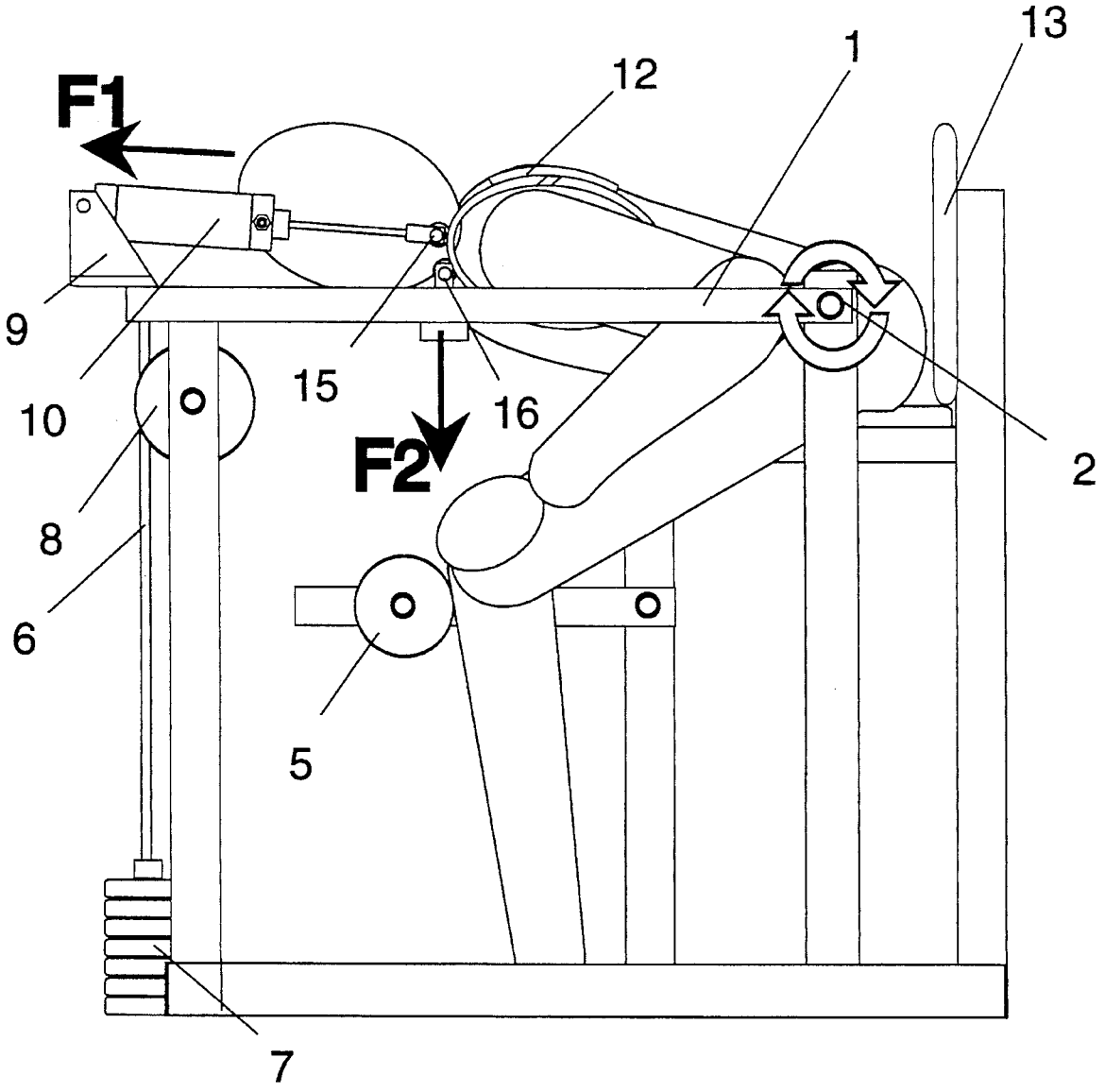
FIG. 2 depicts the interrelationship between a person and the machine shown in FIG. 1

FIG. 2—Human Interface Diagram I

FIG. 2 depicts the interrelationship between a person and the machine. The body interface 12 is donned by a person, while sitting on the seat 13, in a bent over at the waist position as shown. Both knees rest against the body restrainer 5 in order to keep the person in the proper position during the exercise. F1 & F2 represent vector forces applied to the body during exercise. F1 represents a counter compressive force providing a tractive force to the back. F2 represents an Exercise Resistance Force used to exercise the back muscles.

Figure 3:
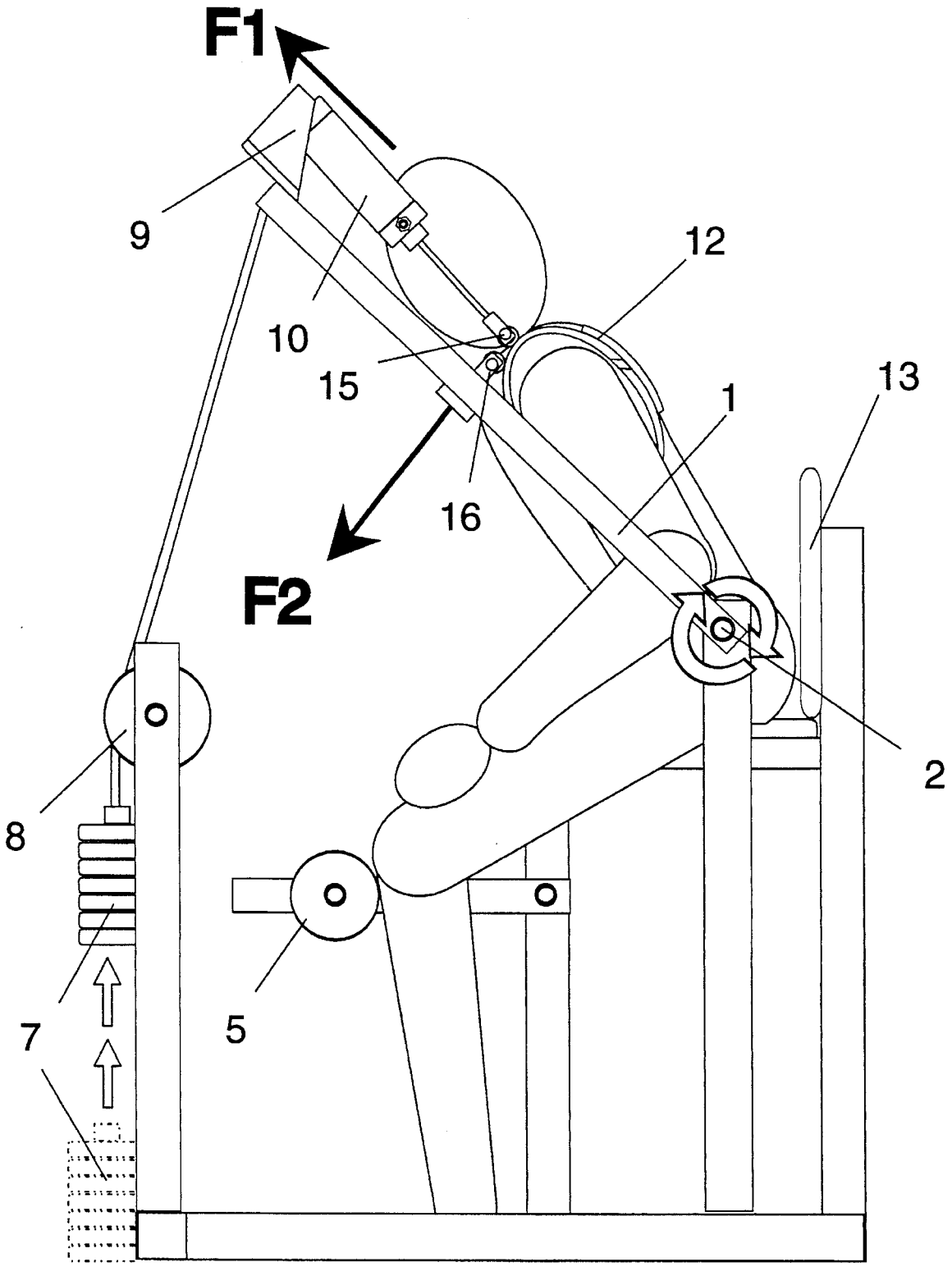
FIG. 3 shows a person and the machine in FIG. 1 during the exercise.

FIG. 3—Human Interface Diagram II

The elements in FIG. 3 are identical to those in FIG. 2 except that the subject and machine are shown at some point in time during the exercise. When a force is applied through the body interface 12, the pivot arm assembly rotates around the pivot arm bearings 2 in a clockwise direction as depicted by the outlined circular arrows. The force device 7, shown in this embodiment as steel plates, moves up and down in conjunction with the pivot arms. This movement is illustrated by the steel plates shown in their at rest state (drawn with dotted lines) and with arrows describing their linear path. These arrows lead to the solid line drawing of the steel plates which represent their present position.

Figure 4:
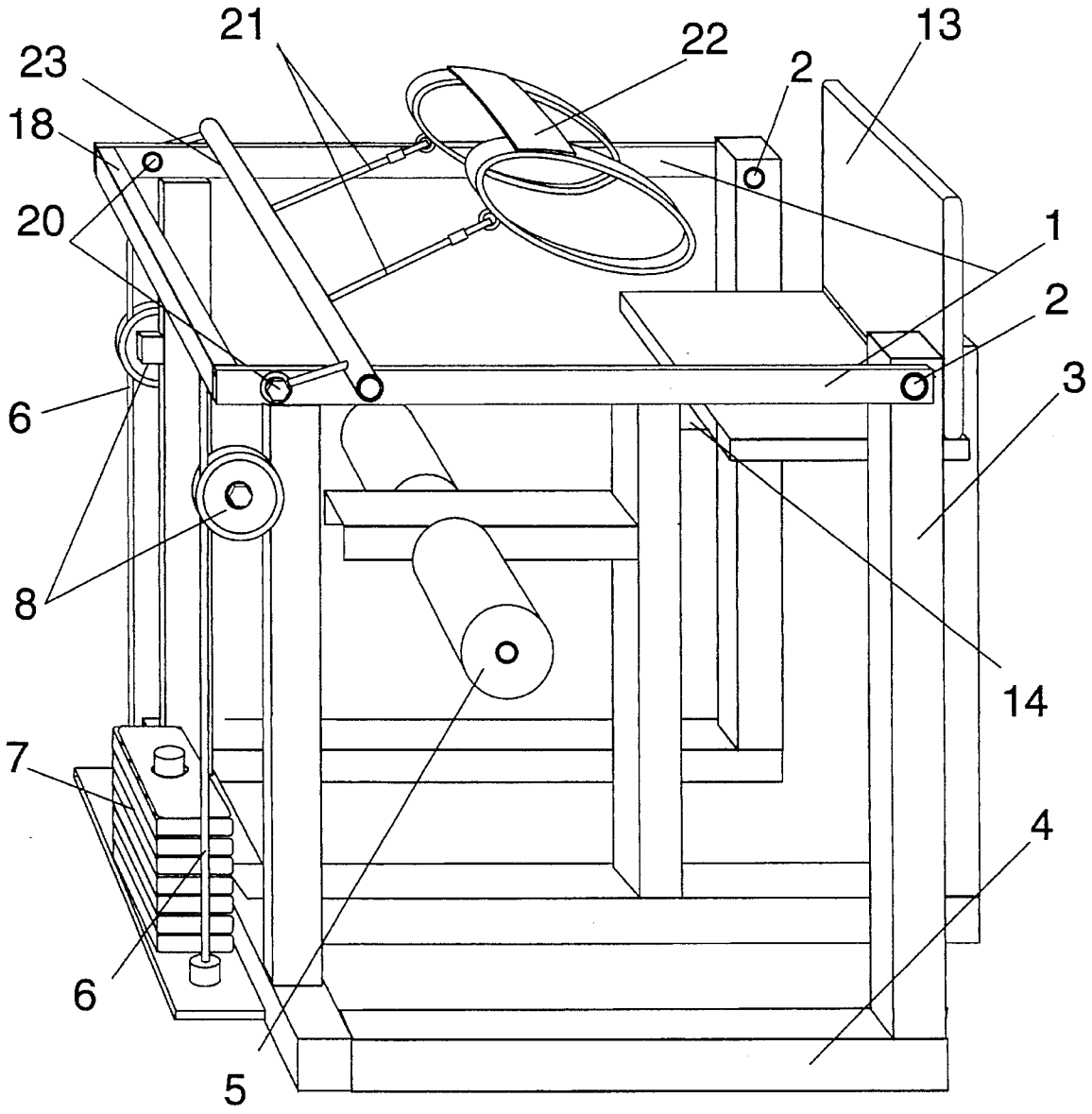
FIG. 4 is a perspective drawing of the invention as it applies to a single force source employed by both the Counter Compressive Force Device and the Exercise Resistive Device.

FIG. 4—Perspective drawing of the invention as it applies to a single force source employed by both the Counter Compressive Force Device and the Exercise Resistive Device. The machine consists of the following:

Pivot arms 1 are mounted on frame posts 3 by means of pivots 2. Two stringers 21 are attached to the body attachment 22 by means of interconnected rings located on the body attachment and stringers as shown. The opposite ends of the stringers 21 are threaded through a spreader bar 23 which in turn is connected to the pivot arms 1 by attachments 20. Cables 6 are fixed to the pivot arm cross member 18, threaded through the pulleys 8 and then connected to the force device 7. For this embodiment steel plates are used as the force device. Body restraint 5 and seat 13 are attached to frame 4 in the positions shown.

Construction of the pivot arms 1 consist of rectangular steel tubing with 0.5" i.d. bronze bushings press fit into the sides. These bushings form the female part of the pivot 2. Holes in the frame posts 3 where the pivot arms attach accept the proper sized steel bearing rod held in place by retaining rings. The frame consists of an "E" shaped base 4 and six upright posts made of steel square tubing. These components are fixed together in the positions shown along with the seat support 14, a horizontal piece located under the seat 13. Two identical ball bearing cable pulleys 8 are used mounted on 0.625" steel hex bolts. Force cables 6 and stringers 21 are 0.25" twisted steel cable. Pivot attachment 20 is solid steel eye bolt construction. In this example the body restrainers take the form of knee rests 5. They are high density urethane foam cylinders attached to a steel tube. The tube is fixed to a horizontal frame attachment which in turn is fixed to the middle frame upright post. Body attachment 22 design consists of two padded leather arm loops connected by a padded leather back support used as a human to machine interface. The seat is made up of two pieces of 0.5" plywood. One piece affixed to the seat support 14 which forms the bottom part of the seat and the other is positioned vertically and attached to an upright forming the back. Foam padding or cushions can be added.

Figure 5:
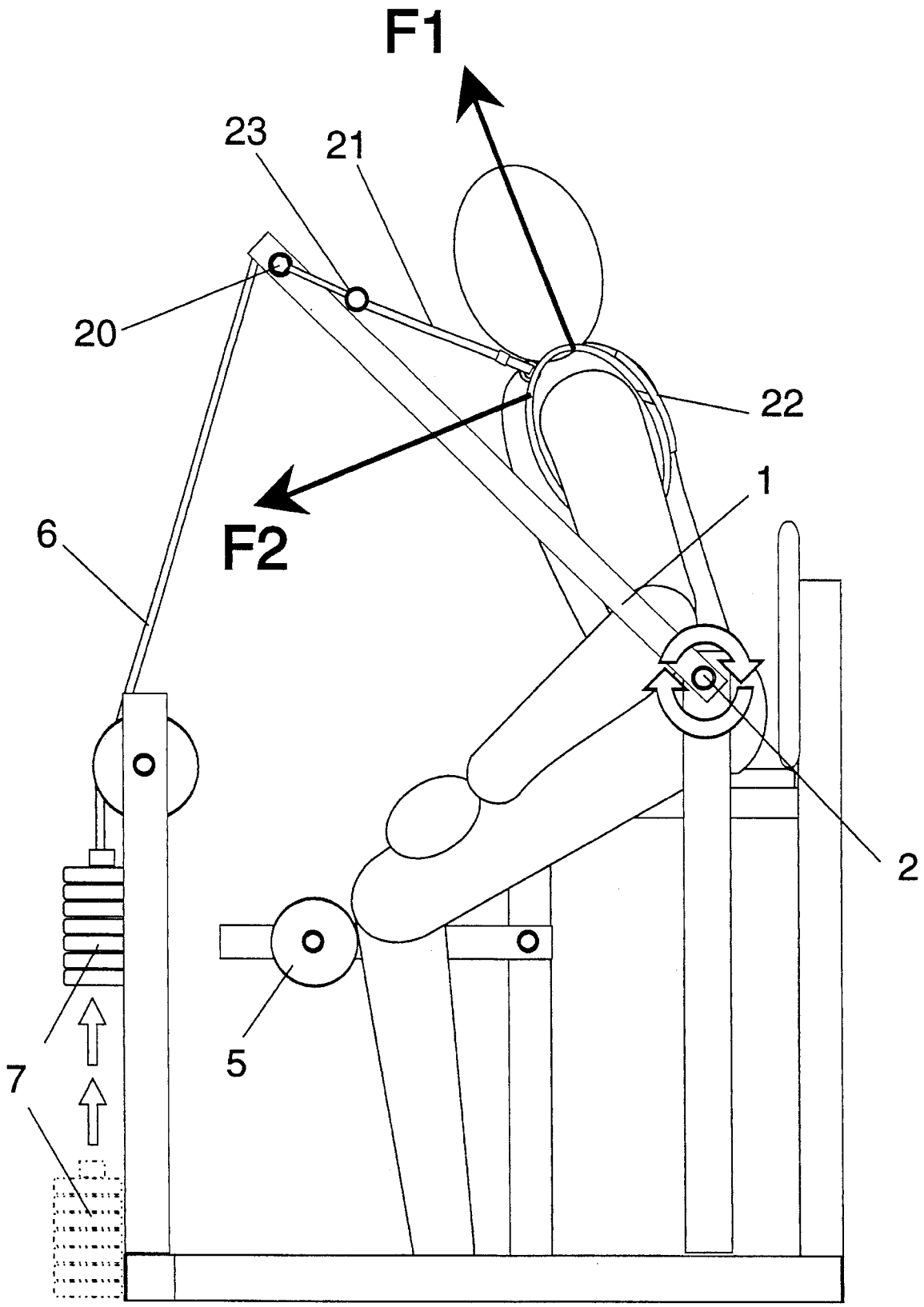
FIG. 5 shows a person and the machine in FIG. 4 during the exercise.

FIG. 5—Human Interface Diagram II-A

The elements in FIG. 5 are identical to those in FIG. 4 except that the subject and machine are shown at some point in time during the exercise.

When a force is applied through the body interface 22, the pivot arm assembly rotates around the pivot arm bearings 2 in a clockwise direction as depicted by the outlined circular arrows. The force device 7, shown in this embodiment as steel plates, moves up and down in conjunction with the pivot arms. This movement is illustrated by the steel plates shown in their at rest state (drawn with dotted lines) and with arrows describing their linear path. These arrows lead to the solid line drawing of the steel plates which represent their present position. F1 & F2 represent vector forces applied to the body during exercise.

Figure 6:
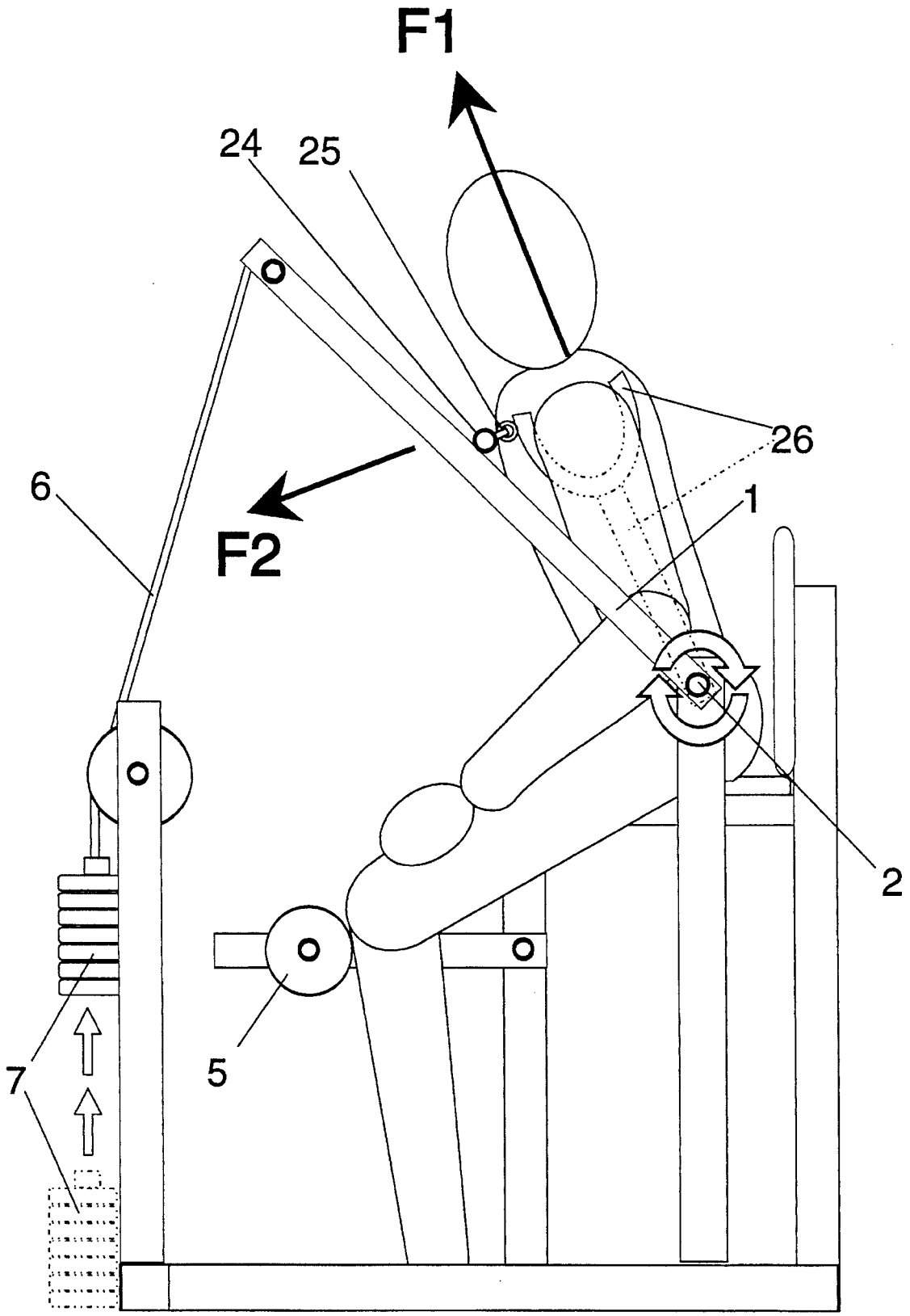
FIG. 6 illustrates an embodiment of the invention which employs an opposing reactive force to said compressive forces.

FIG. 6—Embodiment III, Human Interface Diagram III-A

FIG. 6 depicts a body interface 26 positioned under the subjects arms at one end and to a pivot point on the opposite end. Broken lines are used to show the body interface that is partially hidden from view by the arms. The stringers 25 are attached to the spreader bar 24 and are then connected to the pivot arms 1.

Operation

Selected embodiments of the Counter Compressive Force Exercise Machine that pertain to the lower back are described within. The general principles of operation illustrated in these examples are applied to other muscles and muscle groups in a similar fashion.

Embodiment I FIGS. 2 & 3

FIG. 2 depicts a subject at the beginning of the exercise. The exercise is completed after the subject moves to a vertical upright sitting position, depicted in FIG. 3.

After the subject has donned the body interface 12 and is in a position as shown in FIG. 2, air pressure is introduced to the air cylinders 10 by turning the control knob on the pressure regulator 19. This causes the cylinders to pull the body interface in the approximate direction of F1 providing a counter compressive force to the back.

F1 is a counter compressive force, as shown here as a tractive force, that stretches the back. Frictional and other destructive internal forces upon the back are consequently reduced or eliminated due to the reduction in compressive force.

Force F2 is a Exercise Resistive Force which, in this embodiment, is a force that must be counteracted by the lower back muscles in order to pull the body to an upright sitting position. As the body moves from the position in FIG. 2 toward the upright position in FIG. 3, force from the back muscles is transmitted through the body to the body interface 12. This force is transmitted to the pivot arms 1 via the pivot links 16 and the force bar 17. This causes the pivot arms and its attachments to rotate around pivot 2 consequently lifting, by means of the force cables 6, the steel plates which are the main component of the force device 7. The force pulleys 8 serve as a guides to keep the force device on a linear track and are positioned at a suitable angle in order to transmit the force to the force device and pivot arms. During the motion of exercise the Counter Compressive Force Device, as depicted as air cylinders 10, pivots along with the pivot arms 1 which keeps the desired direction and magnitude of force F1 relatively constant.

Embodiment II FIGS. 4 & 5

FIGS. 4 & 5 show an embodiment whose geometry is such that the effects of both the Counter Compressive Force Device and the Exercise Resistance Device are combined within one device. Accordingly they are attached through one connection to the body interface 22. As the subject moves to a vertical upright sitting position, depicted in FIG. 5, forces as illustrated by vectors F1 and F2 act upon the body in the approximate relation shown. Force F1 is a counter compressive force, shown here as a tractive force, that stretches the lower back. Frictional and other destructive internal forces upon the back are consequently reduced or eliminated due to the reduction in compressive forces acting upon them. Force F2 is a Exercise Resistive Force shown here as a force that must be counteracted by the lower back muscles in order to pull the body to an upright sitting position. As the subject performs the exercise, force from the back muscles is transmitted through the body to the body interface 22. This force is transferred to the pivot arms 1 via the transmit arm which includes the stringers 21, spreader bar 23 and pivot attachments 20. The angle of the stringers 21, in relation to the position of the subject, divides and directs the force into the vectors approximated by F1 and F2. This causes the pivot arms and its attachments to rotate around pivot 2 consequently lifting, by means of the force cables 6, the steel plates which comprise, in this embodiment, the force device 7. The force pulleys 8 serve as guides to keep the force device on a linear track and are positioned to provide a suitable angle to transfer the force to the force device and pivot arms.

Embodiment III FIG. 6

FIG. 6 depicts a different embodiment of the machine. Body interface 26 is fitted under the arms as illustrated and employs a pivot at the opposite end which is situated in a position that corresponds to the pivoting of the waist. This body interface acts as a Counter Compressive Force Device in that it restricts the back from compression by employing an opposing reactive force to said compressive forces. The body interface also acts as an Exercise Resistance Device in a similar way as in embodiment II above with only slight differences. Force generated by the back muscles are transmitted through the body to the body interface 26 which in this embodiment can also be referred to as transmit arm. This force is transferred to the pivot arms 1 via the stringers 25 and spreader bar 24. Accordingly the pivot arms and its attachments rotate around pivot 2 lifting, by means of the force cables 6, the steel plates which comprise, in this embodiment, the force device 7.

What is claimed is:

1. An exercise machine comprising:

a frame;

a pivot arm pivotally coupled to said frame by a pivot means;

a support means attached to said frame adjacent said pivot means adapted to support and position a subject in a seated position;

said support means including a seat;

an exercise resistance means coupled to said pivot arm for resisting pivotal motion of said pivot arm about said pivot means;

a body interface means pivotally coupled to said pivot arm, said body interface means adapted to engage the subject's upper torso;

a counter compressive force device means mounted to said pivot arm producing a force on said body interface means directed away from said pivot means toward said opposite end of said pivot arm;

said body interface means being pivotally coupled to said counter compressive force device means;

whereby the counter compressive force device means imparts a tractive force on the subject's torso as the subject exercises against resistance to pivotal motion of the pivot arm.

* * * * *